US006329132B1

(12) United States Patent
Ihama

(10) Patent No.: US 6,329,132 B1
(45) Date of Patent: Dec. 11, 2001

(54) METHOD OF PREPARING SILVER HALIDE PHOTOGRAPHIC EMULSION

(75) Inventor: Mikio Ihama, Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 1346 days.

(21) Appl. No.: 08/571,031

(22) Filed: Dec. 12, 1995

Related U.S. Application Data

(63) Continuation of application No. 08/249,194, filed on May 26, 1994.

(30) Foreign Application Priority Data

May 26, 1993 (JP) ..... 5-145355

(51) Int. Cl.[7] ..... G03C 1/05

(52) U.S. Cl. ..... 430/569; 430/567; 430/568; 430/571; 430/581; 430/585; 430/589; 430/607

(58) Field of Search ..... 430/567, 568, 430/571, 581, 585, 599, 607, 569

(56) References Cited

U.S. PATENT DOCUMENTS

| | | | | |
|---|---|---|---|---|
| 4,433,048 | | 2/1984 | Solberg et al. | 430/434 |
| 4,656,122 | | 4/1987 | Sowinski et al. | 430/505 |
| 5,240,824 | * | 8/1993 | Takada et al. | 430/567 |

FOREIGN PATENT DOCUMENTS

| | | | |
|---|---|---|---|
| 3-238444 | 10/1991 | (JP) | G03C/1/035 |

OTHER PUBLICATIONS

Meier, H., *Spectral Sensitization*, 74, Focal Press (London, New York), 1968.*

* cited by examiner

*Primary Examiner*—Thorl Chea
(74) *Attorney, Agent, or Firm*—Sughrue, Mion, Zinn, Macpeak & Seas, PLLC

(57) ABSTRACT

In a method of preparing a silver halide photographic emulsion by performing spectral sensitization by adding a cyanine dye during or before chemical sensitization, a substantially insoluble silver iodobromide fine-grain emulsion is added during or after chemical sensitization of the silver halide photographic emulsion.

7 Claims, 1 Drawing Sheet

METHOD OF PREPARING SILVER HALIDE PHOTOGRAPHIC EMULSION

This is a Continuation of application Ser. No. 08/249,194 filed May 26, 1994.

BACKGROUND OF THE INVENTION

1. Field of the Invention

The present invention relates to a method of preparing a silver halide photographic emulsion and, more particularly, to a method of preparing a silver halide photographic emulsion by performing spectral sensitization by adding a cyanine dye during or before chemical sensitization. The present invention also relates to a method of preparing a negative tabular silver halide photographic emulsion in which 50% or more of a total projected area are accounted for by negative tabular grains with an aspect ratio of 3 or more.

2. Description of the Related Art

Generally, the preparation of silver halide photographic emulsions consists of grain formation, desalting, and chemical sensitization. Spectral sensitization using sensitizing dyes is commonly performed by adding the sensitizing dyes when an emulsion subjected to chemical sensitization is to be dissolved during coating. Recently, for the purpose of improving the sensitivity/graininess ratio of a silver halide photographic emulsion, spectral sensitization has begun to be performed by adding sensitizing dyes during or before chemical sensitization, as disclosed in U.S. Pat. No. 4,433,048.

According to the supplementary tests conducted by the present inventors, it is found that the improvement in the sensitivity/graininess ratio obtained by performing spectral sensitization by adding sensitizing dyes during or before chemical sensitization is remarkable when the amount of the sensitizing dyes added is 50% or more, preferably 60% or more of the saturation coverage of silver halide photographic emulsion grains. That is, when spectral sensitization is to be performed by adding sensitizing dyes during or before chemical sensitization, it is necessary to use the sensitizing dyes in an amount larger than those used conventionally.

It is, however, found that, when a large amount of sensitizing dyes is used, the sensitivity/graininess ratio is improved, but the photographic properties are largely degraded while a silver halide photographic emulsion is aged in the form of a solution. The present inventors have found that this problem is posed because agglomeration of emulsion grains occurs due to the addition of a large amount of sensitizing dyes. It is assumed that this agglomeration of silver halide emulsion grains takes place since sensitizing dyes adsorbing at a high covering rate make gelatin lose its protective colloid nature with respect to silver halide emulsion grains.

The agglomeration of silver halide emulsion grains is conspicuous especially in tabular silver halide photographic emulsions in which 50% or more of a total projected area are occupied by tabular grains with an aspect ratio of 3 or more. This reason is assumed that large, smooth surfaces of tabular grains are readily brought into contact with each other to aggregate.

The problem to be solved by the present invention and, naturally, the method of the invention are conventionally unknown. U.S. Pat. No. 4,656,122 discloses that high-sensitivity, high-contrast reversal images can be obtained by mixing tabular silver halide grains and a fine-grain silver halide with solubility higher than that of the tabular silver halide grains. This disclosure is different from the present invention in respect of the relationship of the silver iodide content between the tabular silver halide grains and the fine-grain silver halide. In addition, the disclosure is a special effect obtained in only a system in which reversal images are formed.

JP-A-3-238444 ("JP-A" means Unexamined Published Japanese Patent Application) discloses that the adsorption of sensitizing dyes is enhanced to improve the aging stability at high temperatures and high humidities by adding to a silver iodobromide emulsion silver halide fine grains with a silver iodide content larger than that on the surface of the emulsion. This invention disclosed in JP-A-3-238444 is based on the dissolution of the silver halide fine grains and is therefore different from the present invention which is based on the addition of the insoluble silver iodobromide fine grains.

SUMMARY OF THE INVENTION

It is an object of the present invention to provide a method of preparing a silver halide photographic emulsion, particularly a negative tabular silver halide photographic emulsion, by which the agglomeration of silver halide grains which is of a problem in improving the sensitivity/graininess ratio is eliminated by performing spectral sensitization by adding a large amount of cyanine dyes during or before chemical sensitization.

The present inventors have found that, in a method of preparing a silver halide photographic emulsion by performing spectral sensitization by adding cyanine dyes during or before chemical sensitization, the agglomeration of silver halide photographic emulsion grains is improved significantly by adding an substantially insoluble silver iodobromide fine-grain emulsion during or after chemical sensitization of the silver halide photographic emulsion. It is particularly noteworthy that the color sensitization sensitivity also is further improved by the present invention.

The above-mentioned object of the present invention has been achieved by the following means.

(1) A method of preparing a silver halide photographic emulsion by performing spectral sensitization by adding a cyanine dye during or before chemical sensitization, wherein a substantially insoluble silver iodobromide fine-grain emulsion is added during or after chemical sensitization of the silver halide photographic emulsion.

(2) A method of preparing a silver halide photographic emulsion by performing spectral sensitization by adding a cyanine dye during or before chemical sensitization, wherein a substantially insoluble silver iodobromide grain emulsion with an average equivalent-circle diameter of 0.05 to 0.30 $\mu$m and a surface silver iodide content of 3 to 20 mol% is added during or after chemical sensitization of the silver halide photographic emulsion.

(3) A method of preparing a tabular silver halide photographic emulsion, in which not less than 50% of a total projected area are accounted for by tabular grains with an aspect ratio of not less than 3, by performing spectral sensitization by adding a cyanine dye during or before chemical sensitization, wherein a substantially insoluble silver iodobromide grain emulsion with an average equivalent-circle diameter of 0.05 to 0.30 $\mu$m and a surface silver iodide content of 3 to 20 mol% is added during or after chemical sensitization of the silver halide photographic emulsion.

(4) A method of preparing a negative tabular silver halide photographic emulsion, in which not less than 50% of a total projected area are accounted for by negative tabular grains with an aspect ratio of not less than 3, by performing spectral sensitization by adding a cyanine dye during or before chemical sensitization, wherein a substantially insoluble silver iodobromide grain emulsion with an average equivalent-circle diameter of 0.05 to 0.30 μm and a surface silver iodide content of 3 to 20 mol% is added during or after chemical sensitization of the silver halide photographic emulsion.

(5) A method of preparing a negative tabular silver halide photographic emulsion, in which not less than 50% of a total projected area are accounted for by negative tabular grains with an aspect ratio of not less than 5, by performing spectral sensitization by adding a trimethinecyanine dye during or before chemical sensitization, wherein a substantially insoluble silver iodobromide fine-grain emulsion with a sensitivity not higher than 1/10 the sensitivity of said silver halide photographic emulsion is added at the end of chemical sensitization of the silver halide photographic emulsion.

(6) A method of preparing a negative tabular silver halide photographic emulsion, in which not less than 50% of a total projected area are accounted for by negative tabular grains with an aspect ratio of not less than 5, by performing spectral sensitization by adding a trimethinecyanine dye in an amount of not less than 60% of a saturation coverage amount during or before chemical sensitization, wherein a substantially insoluble silver iodobromide fine-grain emulsion with a sensitivity not higher than 1/10 the sensitivity of said silver halide photographic emulsion is added at the end of chemical sensitization of the silver halide photographic emulsion.

(7) The method described in item (6) above, wherein a silver iodobromide fine-grain emulsion consisting of regular crystal is added.

DETAILED DESCRIPTION OF THE PREFERRED EMBODIMENTS

Figure 1:
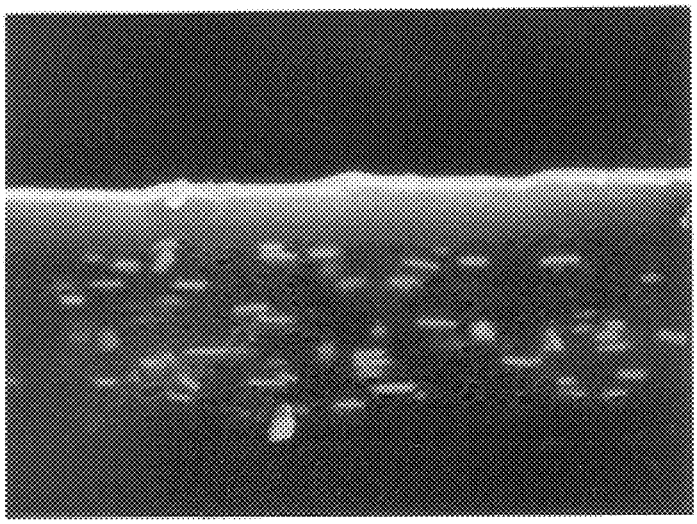
FIG. 1 is a sectional electron micrograph of a coated sample showing the grain structure of an emulsion A-4 prepared in one example of the present invention and not aged in the form of a solution.

The present invention will be described in detail below.

The silver halide emulsions of the present invention are spectrally sensitized by adding cyanine dyes during or before chemical sensitization. An example of the cyanine dye useful in the present invention is a dye represented by Formula (I) below:

Formula (I)

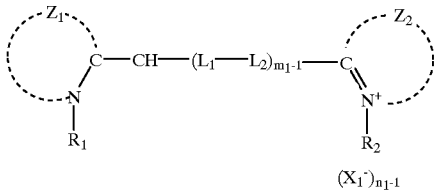

In Formula (I), each of $Z_1$ and $Z_2$ represents a heterocyclic nucleus normally used in a cyanine dye, particularly an atomic group required to complete, e.g., thiazole, thiazoline, benzothiazole, naphthothiazole, oxazole, oxazoline, benzoxazole, naphthoxazole, tetrazole, pyridine, quinoline, imidazoline, imidazole, benzoimidazole, naphthoimidazole, selenazoline, selenazole, benzoselenazole, naphthoselenazole, or indolenine. These nuclei may be substituted by, e.g., a lower alkyl group such as methyl, a halogen atom, a phenyl group, a hydroxyl group, an alkoxy group with one to four carbon atoms, a carboxyl group, an alkoxycarbonyl group, an alkylsulfamoyl group, an alkylcarbamoyl group, an acetyl group, an acetoxy group, a cyano group, a trichloromethyl group, a trifluoromethyl group, or a nitro group.

$L_1$ or $L_2$ represents a methine group or a substituted methine group. Examples of the substituted methine group are methine groups substituted with a lower alkylene group such as methyl and ethyl, phenyl, substituted phenyl, methoxy, and ethoxy.

Each of $R_1$ and $R_2$ represents an alkyl group with one to five carbon atoms; a substituted alkyl group with a carboxy group; a substituted alkyl group with a sulfo group, such as β-sulfoethyl, γ-sulfopropyl, δ-sulfobutyl, γ-sulfobutyl, 2-(3-sulfopropoxy)ethyl, 2-[2-(3-sulfopropoxy)ethoxy]ethyl, or 2-hydroxy sulfopropyl; or a substituted alkyl group normally used as an N-substituted group of a cyanine dye, such as an allyl group or the like. $m_1$ represents 1, 2, or 3. $X_1^-$ represents an acid anion group normally used in a cyanine dye, such as iodine ion, bromine ion, p-toluenesulfonic acid ion, or perchloric acid ion. $n_1$ represents 1 or 2; $n_1$ is 1 when a betaine structure is to be formed.

The effect of the present invention is notable especially when a trimethinecyanine dye in which $m_1$ is 2 is used.

Representative compounds as an effective spectral sensitizing dye for use in the present invention are as follows.

I-1

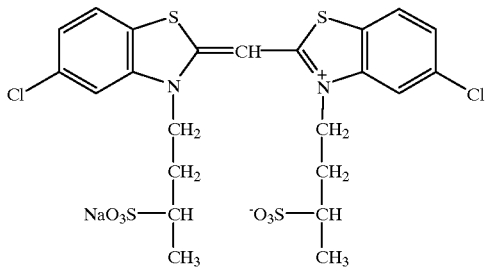

-continued
I-2
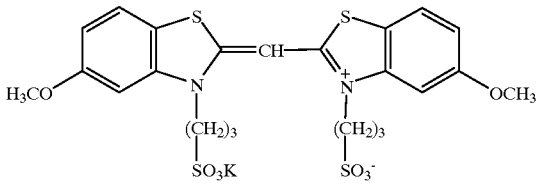
I-3
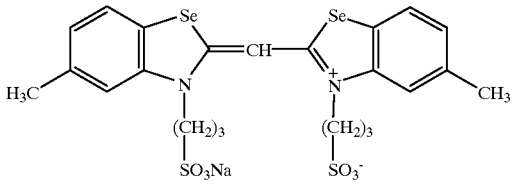
I-4
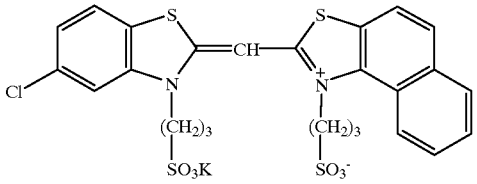
I-5
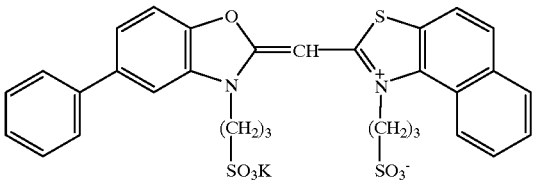
I-6
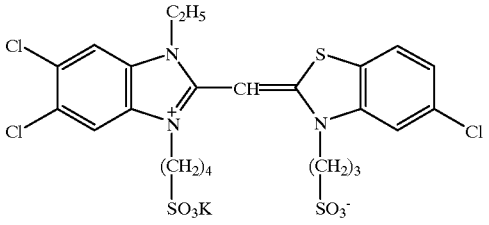
I-7
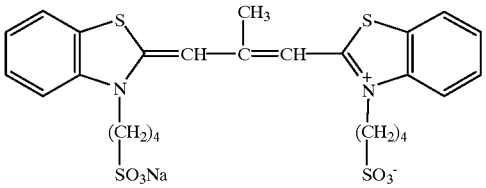
I-8
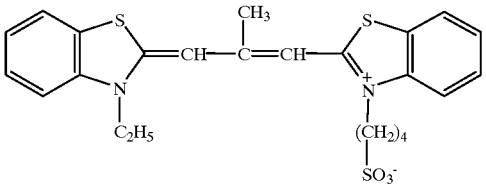
-continued
I-9
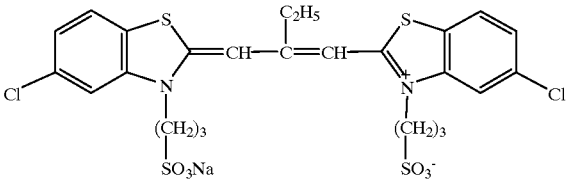
I-10
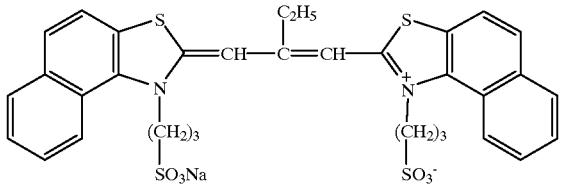
I-11
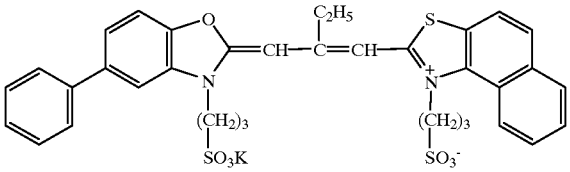
I-12
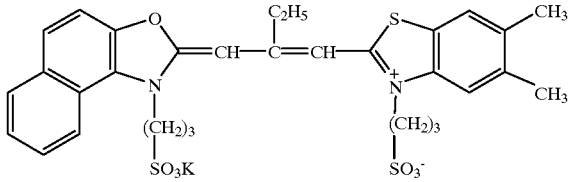
I-13
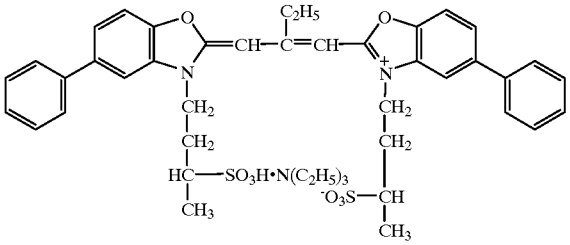
I-14
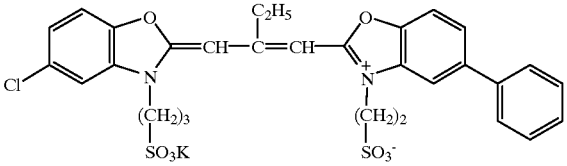
I-15
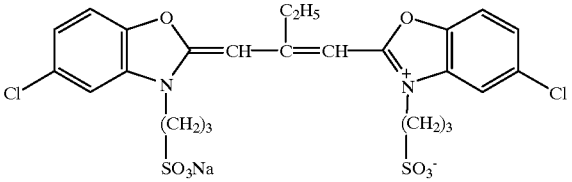

-continued

I-16

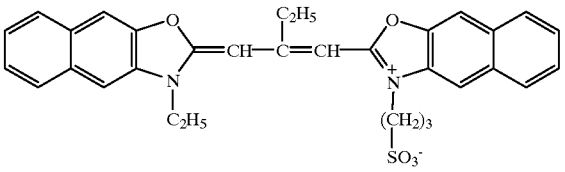

I-17

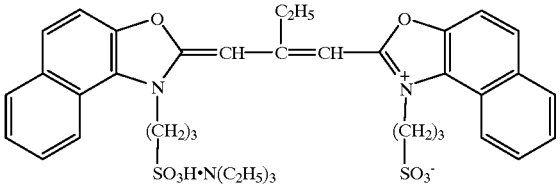

I-18

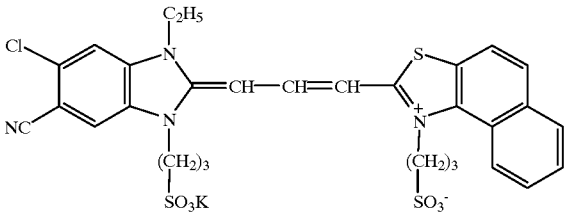

I-19

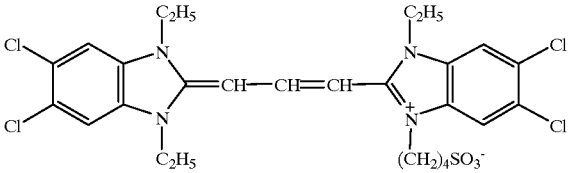

I-20

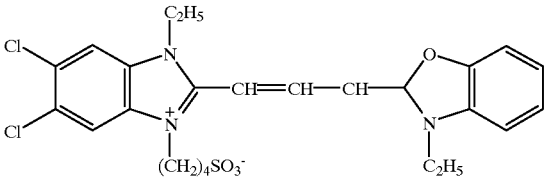

I-21

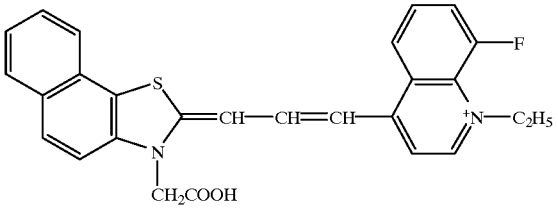

I-22

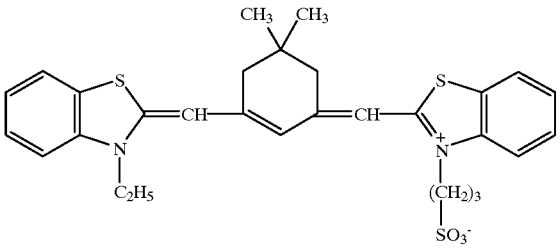

-continued

I-23

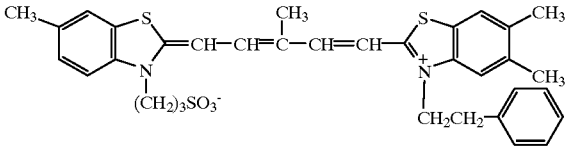

I-24

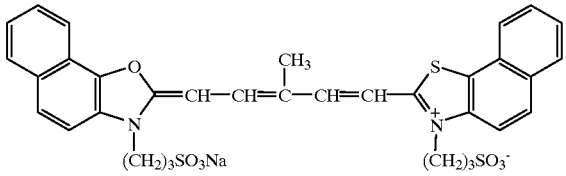

I-25

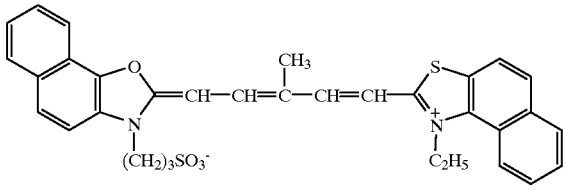

I-26

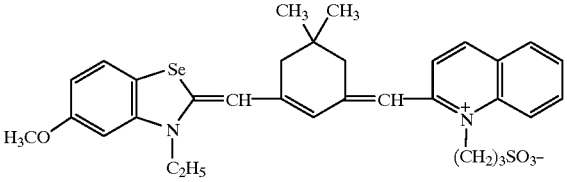

Examples of the spectral sensitizing dye other than the above sensitizing dyes are described in, e.g., German Patent 929,080, U.S. Pat. Nos. 2,493,748, 2,503,776, 2,519,001, 2,912,329, 3,656,956, 3,672,897, 3,694,217, 4,025,349, 4,046,572, 2,688,545, 2,977,229, 3,397,060, 3,552,052, 3,527,641, 3,617,293, 3,628,964, 3,666,480, 3,672,898, 3,679,428, 3,703,377, 3,814,609, 3,837,862, and 4,026,344, British Patents 1,242,588, 1,344,281, and 1,507,803, JP-B-44-14030 ("JP-B" means Examined Published Japanese Patent Application), JP-B-52-24844, JP-B-43-4936, JP-B-53-12375, JP-A-52-110618, JP-A-52-109925, and JP-A-50-80827.

The amount of sensitizing dyes to be added during the preparation of a silver halide emulsion depends upon the types of additives or the type of silver halide used. It is, however, possible to use sensitizing dyes in an amount equal to or larger than those used in conventional methods.

That is, the addition amount of sensitizing dyes is preferably 0.001 to 100 mmol, and more preferably 0.1 to 10 mmol per mol of silver halide.

In the present invention, the addition amount of sensitizing dyes is most preferably 60% or more, particularly 70% to 100% with respect to the saturation coverage of silver halide emulsion grains. The saturation coverage of a sensitizing dye with respect to silver halide emulsion grains can be calculated easily by obtaining the adsorption isotherm of an ordinary sensitizing dye.

A cyanine dye as the sensitizing dye is added during or before chemical sensitization. "During chemical sensitization" means a period essentially before the end of the chemical sensitization. The period before the chemical sensitization includes, e.g., grain formation, physical ripening, washing, and dispersion.

The sensitizing dye can be added by any given method. As an example, the sensitizing dye can be added by dissolving in water or an organic solvent, such as alcohols, glycols, ketones, esters, or amides. It is also possible to use a method by which the dye is dispersed in water with the aid of a dispersant (surfactant) and directly added in the form of a dispersion or added in the form of a powder obtained by drying the resultant dispersion; a method by which the dye is mixed in a dispersant by using gelatin as a binder and directly added in the form of a homogeneous mixture (a gel, a paste, or a slurry) or added in the form of a granular product obtained by drying the mixture; and a method by which the dye is milled into fine grains with a diameter of 1 $\mu$m or less in water and added in the form of a dispersion without using any dispersant (a binder such as gelatin can be used).

An emulsion may contain, in addition to the sensitizing dyes, a dye not having a spectral sensitizing effect or a substance not essentially absorbing visible light but exhibiting supersensitization. Examples of the substance are an aminostyl compound substituted by a nitrogen-containing heterocyclic group (described in, e.g., U.S. Pat. Nos. 2,933,390 or 3,635,721), an aromatic organic acid formaldehyde condensate (described in, e.g., U.S. Pat. No. 3,743,510), cadmium salt, and an azaindene compound. The combinations described in U.S. Pat. Nos. 3,615,613, 3,615,641, 3,617,295, and 3,635,721 are most useful.

The emulsion of the present invention consists of tabular silver halide grains with an aspect ratio of preferably 3 or more.

The "tabular grain" is a general term of grains having one twin plane or two or more parallel twin planes. The twin plane is (111) faces if all ions at lattice points on the both sides of this (111) faces have a mirror image relationship to each other. When this tabular grain is viewed from the above, it looks like a triangle, a hexagon, or a circular triangle or hexagon. The triangular, hexagonal, and circular grains have parallel triangular, hexagonal, and circular outer surfaces, respectively.

The aspect ratio of the tabular grain is preferably 3 or more, and more preferably 4 or more, and most preferably 5 or more for the effect of the present invention. Tabular grains with high aspect ratios have high surface area/volume ratios and large, smooth major faces and therefore readily cause aggregation of grains which is due to sensitizing dyes.

In the present invention, the aspect ratio of a tabular grain is the value obtained by dividing the grain diameter of a tabular grain by the thickness of that grain. The thickness of a grain can be easily measured by depositing a metal together with a latex as a reference obliquely on a grain, measuring the length of the shadow of the latex in an electron micrograph, and calculating by referring to the length of the shadow of the latex.

In the present invention, the grain diameter is the diameter of a circle having an area equal to the projected area of parallel outer surfaces of a grain.

The projected area of a grain can be obtained by measuring the area in an electron micrograph and correcting the photographing magnification.

The diameter of the tabular grain is preferably 0.15 to 5.0 $\mu$m, and its thickness is preferably 0.05 to 1.0 $\mu$m. Within these ranges, the highest sensitivity/graininess ratio for photographic emulsions can be obtained.

In the emulsion of the present invention, tabular grains account for preferably 50% or more, and most preferably 80% or more of the total projected area.

The silver halide photographic emulsion is more preferably an emulsion in which 70% or more of the total projected area of silver halide grains are occupied by a hexagonal tabular silver halide, in which the ratio of the length of an edge having the maximum length with respect to the length of an edge having the minimum length is 2 or less, and which has two parallel faces as outer surfaces. In addition, the emulsion has monodispersibility by which a variation coefficient of a grain size distribution of these hexagonal tabular silver halide grains (i.e., a value obtained by dividing a variation (standard deviation) in grain sizes, which are represented by equivalent-circle diameters of projected areas of the grains, by their average grain size) is 30% or less, an aspect ratio of 3 or more, and a grain diameter of 0.2 $\mu$m or more.

The emulsion of the present invention is preferably a negative tabular silver halide photographic emulsion. This is so because the effect of increasing the sensitivity obtained by performing spectral sensitization by adding cyanine dyes during or before chemical sensitization is remarkable in the negative tabular silver halide photographic emulsion. The "negative" means that blackening or a coloring density increases with an increase in an exposure amount.

The halogen composition of silver halide grains contained in the photographic emulsion of the present invention may be any of silver bromide, silver iodobromide, silver bromochloroiodide, silver chlorobromide, silver chloride, and silver iodochloride. The halogen composition is preferably silver bromide, silver iodobromide, silver iodochloride, or silver bromochloroiodide.

The silver halide grain of the present invention may have a layered structure of at least two layers in which substantially different halogen compositions are contained in the silver halide grain, or may have a homogenous composition.

The emulsion having the layered structure consisting of different halogen compositions may be an emulsion containing a high silver iodide layer in the core portion and a low silver iodide layer in the outermost layer (shell portion), or may be a silver iodobromide or bromochloroiodide emulsion containing a low silver iodide layer in the core portion and a high silver iodide layer in the outermost layer. Also, the emulsion may contain a high silver chloride layer in the core portion and a low silver chloride layer in the outermost layer, or may be a silver bromochloroiodide or chlorobromide emulsion containing a low silver chloride layer in the core portion and a high silver chloride layer in the outer most layer. The layered structure also can consist of three or more layers.

In the process of grain formation or physical ripening of the tabular silver halide emulsion of the present invention, it is possible to use, e.g., cadmium salt, zinc salt, thallium salt, iridium salt or its complex salt, rhodium salt or its complex salt, or iron salt or its complex salt.

In the manufacture of the tabular grains of the present invention, the grain size, the grain shape (e.g., the diameter/thickness ratio), the grain size distribution, and the grain growth rate can be controlled by using a silver halide solvent as needed. The amount of the solvent is preferably $1\times10^{-3}$ to 1.0 wt %, and most preferably $1\times10^{2}$ to $1\times10^{-1}$ wt % of the reaction solution.

As the amount of the solvent is increased, the monodispersibility of the grain size distribution and the growth rate can be increased. On the other hand, the grain thickness tends to increase with increasing amount of the solvent.

Examples of the silver halide solvent often used are ammonia, rhodan, thioether, and thioureas. Thioether is described in, e.g., U.S. Pat. Nos. 3,271,157, 3,790,387, and 3,574,628. Among other silver halide solvents, the use of rhodan is most preferred.

The emulsion of the present invention is preferably sensitized by at least three different sensitizers, i.e., a selenium sensitizer, a gold sensitizer, and a sulfur sensitizer.

The chemical sensitization of the present invention can be performed more effectively in the presence of the silver halide solvent.

Examples of the silver halide solvent usable in the present invention are (a) organic thioethers described in U.S. Pat. Nos. 3,271,157, 3,531,289, and 3,574,628, JP-A-54-1019, and JP-A-54-158917, (b) thiourea derivatives described in JP-A-53-82408, JP-A-55-77737, and JP-A-55-2982, (c) a silver halide solvent having a thiocarbonyl group sandwiched between an oxygen or sulfur atom and a nitrogen atom, described in JP-A-53-144319, (d) imidazoles described in JP-A-54-100717, (e) sulfite, and (f) thiocyanate.

Most preferable examples of the silver halide solvent are thiocyanate and tetramethylthiourea. Although the amount of the solvent to be used changes in accordance with its type, a preferable amount is, in the case of thiocyanate, $1\times10^{-4}$ to $1\times10^{-2}$ mol per mol of silver halide.

In the present invention, a silver iodobromide fine-grain emulsion is added during or after chemical sensitization in the process of preparing a silver halide photographic emulsion in which cyanine dyes are added during or before the chemical sensitization. "During chemical sensitization" means a period essentially before the end of the chemical sensitization. "After chemical sensitization" means, e.g., a timing at the end of the chemical sensitization or a timing of dissolution performed during coating.

The silver iodobromide fine-grain emulsion is most preferably added at the end of the chemical sensitization. The silver iodobromide fine-grain emulsion is particularly preferably added at the end of the chemical sensitization and ripened at the same temperature as in the chemical sensitization for one to 20 minutes, more preferably two to ten minutes. Ripening at high temperatures for extended periods of time may lead to dissolution of the silver iodobromide fine-grain emulsion, so the effect of the present invention cannot be obtained in some cases.

The silver iodobromide fine-grain emulsion of the present invention has an average equivalent-circle diameter of 0.05 to 0.30 $\mu$m, preferably 0.08 to 0.20 mm.

Although the silver iodobromide fine-grain emulsion may have either a polydisperse or monodisperse distribution, it is preferable that the emulsion consists of monodisperse grains with a variation coefficient of 20% or less, more preferably 15% or less.

The silver iodobromide fine-grain emulsion of the present invention consists of silver iodobromide grains with a surface silver iodide content of 3 to 20 mol%, more preferably 5 to 15 mol%. The emulsion may also contain silver chloride within a range over which the effect of the present invention is interfered with. The surface silver iodide content can be generally calculated from the formulation in the preparation of the silver iodobromide fine-grain emulsion. If the calculation from the formulation is difficult, the surface silver iodide content can be measured by an XPS method.

The principle of the XPS method is described in, e.g., Jun'ichi Aihara et al., "Electron Spectroscopy," (Kyoritsu Library 16, Kyoritsu Shuppan, 1978).

A standard measuring method of the XPS is to use Mg-Ka as excitation X-rays to measure the intensity of photoelectrons of iodine (I) and silver (Ag) released from silver halide grains in the form of an appropriate sample.

The content of iodine can be calculated from a calibration curve which is formed by using several types of standard samples with known iodine contents and indicates the photoelectron intensity ratio (intensity (I)/intensity (Ag)) of iodine (I) to silver (Ag). In silver halide emulsions, the XPS measurement must be performed after gelatin adsorbed on the surfaces of silver halide grains is decomposed and removed by using, e.g., proteolytic enzyme.

Although the preferable addition timing, grain size, and silver iodide content of the silver iodobromide fine-grain emulsion of the present invention have been discussed above, the silver iodobromide fine-grain emulsion of the present invention is substantially insoluble. That is, the silver iodobromide fine-grain emulsion added during or after chemical sensitization does not dissolve to deposit on a silver halide photographic emulsion but substantially keeps its shape and size within ranges over which the effect of the present invention is not degraded. The dissolution of the silver iodobromide fine-grain emulsion is kept at preferably 20% or less, more preferably 10% or less, and most preferably 5% or less.

The silver iodobromide fine grain of the present invention may have different phases in the interior and the surface layer or may have a multi-phase structure with a Functioned structure. Also, an overall grain may consist of a homogenous phase. A mixture of these forms is also possible.

As the silver iodobromide fine grain of the present invention, it is possible to use cubic, octahedral, tetradecahedral, plate-like, and potato-like grains. Among these forms, the use of regular-crystal grains, such as octahedral, cubic, potato-like, and tetradecahedral grains, is preferred.

The silver iodobromide fine-grain emulsion used in the present invention can be prepared by the methods described in, e.g., P. Glafkides, Chimie et Physique Photographique, Paul Montel, 1967; G. F. Duffin, Photographic Emulsion Chemistry, Focal Press, 1966; and V. L. Zelikman et al., Making and Coating Photographic Emulsion, Focal Press, 1964.

That is, any of an acid method, a neutral method, and an ammonia method can be used. In forming grains by a reaction of a soluble silver salt and a soluble halogen salt, any of a single-jet method, a double-jet method, and a combination of these methods can be used.

It is also possible to use a method (so-called reverse double-jet method) of forming grains in the presence of excess silver ion. As one type of the double-jet method, a method in which the pAg of a liquid phase for producing a silver halide is maintained constant, i.e., a so-called controlled double-jet method can be used.

The silver iodobromide fine-grain emulsion of the present invention is preferably added in an amount of 1 to 10 mol%, as a silver amount, with respect to a silver halide emulsion which is to be spectrally sensitized by adding cyanine dyes during or before chemical sensitization. The addition amount is more preferably 2 to 8 mol%. The silver iodobromide fine-grain emulsion can be added either continuously or at one time.

The sensitivity of the silver iodobromide fine-grain emulsion of the present invention is preferably 1/10 or less that of a silver halide emulsion which is to be spectrally sensitized by adding cyanine dyes during or before chemical sensitization. In addition, the silver iodobromide fine-grain emulsion is not substantially fogged in both the surface layer and the interior. Therefore, chemical sensitization of this silver iodobromide fine-grain emulsion is usually unnecessary, but better results sometimes can be obtained by chemical sensitization. Likewise, although it is preferable that the silver iodobromide fine-grain emulsion be not substantially, spectrally sensitized by cyanine dyes, spectral sensitization using a small amount of cyanine dyes is favorable in some cases. Therefore, spectral sensitization within a range over which the effect of the present invention is not interfered with is possible, but performing no spectral sensitization is more favorable.

The photographic and fine-grain emulsions used in the present invention may contain various compounds in order to prevent fog during the preparing process, storage, or photographic processing of a light-sensitive material, or to stabilize the photographic properties. Usable compounds are those known as an antifoggant or a stabilizer, for example, azoles, preferably those having a water-soluble group, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly 4-hydroxy-substituted(1,3,3a,7) tetrazaindenes), pentazaindenes; and a compound, such as benzenethiosulfonic acid, benzenesulfinic acid, and amide benzenesulfonate.

In the present invention, these antifoggants or stabilizers are added particularly preferably at the end of chemical sensitization. More preferably, the silver iodobromide fine-grain emulsions are added after the addition of these antifoggants or stabilizers. It is also favorable to add the antifoggants or stabilizers to the silver iodobromide fine-grain emulsions beforehand.

The silver halide photographic emulsions of the present invention can be applied to preferably negative color and black-and-white light-sensitive materials. Examples are color and black-and-white negative films for general purposes and movies. The emulsions of the present invention is also applicable to black-and-white light-sensitive materials for X-ray and printing purposes and microfilms.

Techniques and inorganic and organic materials which can be used when the emulsions of the present invention are applied to a color photographic light-sensitive material are described in the portions of JP-A-3-161745 presented below.

1. Layer arrangement: page 28, lower left column, line 1 to page 29, upper right column, line 7
2. Silver halide emulsion: page 29, upper right column, line 8 to page 30, upper right column, line 12
3. Yellow coupler: page 30, lower right column, lines 5 to 11
4. Magenta coupler: page 30, lower right column, line 12 to page 31, line 3
5. Cyan coupler: page 31, upper left column, lines 4 to 16
6. Polymer coupler: page 31, upper left column, line 17 to upper right column, line 1
7. Functional coupler: page 31, upper right column, line 2 to lower right column, line 5
8. Antiseptic and antifungal agents: page 32, upper right column, lines 10 to 17
9. Formalin scavenger: page 30, lower left column, lines 16 to 20
10. Other additives: page 35, lower right column, line 19 to page 36, upper left column, line 14, and page 30, upper right column, line 13 to lower left column, line 15
11. Dispersion method: page 31, lower right column, line 8 to page 32, upper right column, line 9
12. Support: page 32, lower left column, lines 4 to 6
13. Thickness and physical properties of film: page 32, lower left column, line 7 to lower right column, line 10
14. Color development process: page 32, lower right column, line 15 to page 33, lower right column, line 16
15. Desilvering process: page 32, lower right column, line 17 to page 35, upper left column, line 16
16. Automatic developing machine: page 35, lower left column, line 17 to upper right column, line 5
17. Washing/stabilizing process: page 35, upper right column, line 6 to lower right column, line 15

The present invention will be described in more detail below by way of its examples, but the invention is not limited to these examples. Various change may be made without departing the scope of the present invention.

EXAMPLES

Example 1

The problems of a silver halide photographic emulsion spectrally sensitized by adding cyanine dyes before chemical sensitization and the effects of the present invention will be described.

(Preparation of emulsion A)

A 1,000 ml portion of an aqueous solution containing 6 g of gelatin with an average molecular weight of 10,000 and 4.5 g of KBr was stirred at 30° C., and an aqueous $AgNO_3$ solution (7.3 g) and an aqueous KBr solution (5.3 g) were added by a double-jet method. After gelatin was added to the resultant solution, the temperature was raised to 70° C. The silver potential was adjusted to −30 mV with respect to a saturated calomel electrode, and an aqueous $AgNO_3$ solution (141.1 g) and an aqueous KBr solution (containing 12 mol% of KI) were added by the double-jet method while the flow rates were accelerated. During the addition, the silver potential was kept at −30 mv with respect to the saturated calomel electrode. After the temperature was decreased to 40° C., the silver potential was adjusted to −10 mv with respect to the saturated calomel electrode. An aqueous silver nitrate solution ($AgNO_3$ 4.2 g) and an aqueous KI solution (4.1 g) were added to the resultant solution over five minutes, and the temperature was raised to 60° C. After the silver potential was adjusted to −60 mv with respect to the saturated calomel electrode, an aqueous silver nitrate solution ($AgNO_3$ 60 g) and an aqueous KBr solution were added by the double-jet method over 12 minutes while the flow rates were accelerated. During the addition, the silver potential was kept at −60 mV with respect to the saturated calomel electrode. After the temperature was decreased, desalting was performed by a regular flocculation method. Gelatin was added to adjust the pAg and the pH to 8.6 and 5.8, respectively, at 40° C. The resultant emulsion was found to consist of tabular grains with an average equivalent-circle diameter of 1.60 $\mu$m (variation coefficient 29%), an average thickness of 0.29 $\mu$m, and an average aspect ratio of 5.5. When grains were selected in an amount corresponding to 50% of a total projected area from those having high aspect ratios, the average aspect ratio of these grains was 7.7.

The emulsion A was held at 60° C., and sensitizing dyes D-1, D-2, and D-3 presented below were added in the amounts listed in Table 1 below. Thereafter, chemical sensitization was optimally performed by adding potassium thiocyanate, a gold sensitizer, a sulfur sensitizer, and a selenium sensitizer in amounts of $3.0\times10^{-3}$, $1.5\times10^{-6}$, $5.3\times10^{-6}$, and $4.2\times10^{-6}$ mol/molAg, respectively. After the chemical sensitization, $2\times10^{-4}$ mol/molAg of an antifoggant F-1 presented below was added.

D-1

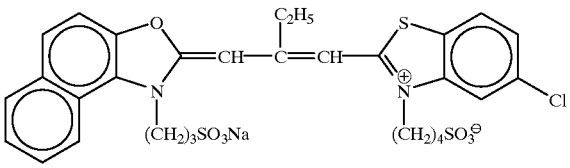

D-2

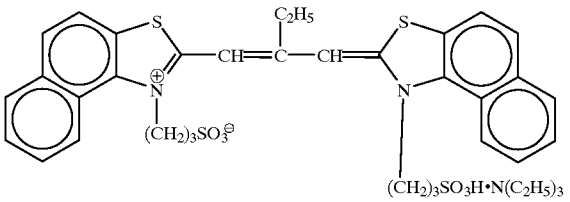

D-3

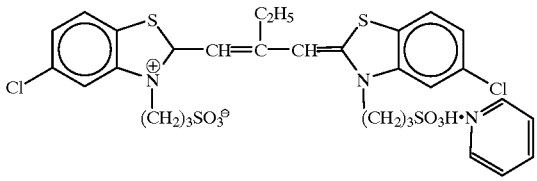

F-1

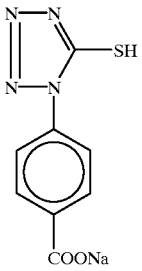

TABLE 1

| Emulsion name | Addition amount (mol/molAg) of sensitizing dye D-1 | D-2 | D-3 |
|---|---|---|---|
| A-1 | $2.1\times10^{-4}$ | $2.1\times10^{-5}$ | $4.2\times10^{-4}$ |
| A-2 | $2.4\times10^{-4}$ | $2.4\times10^{-5}$ | $4.8\times10^{-4}$ |
| A-3 | $2.7\times10^{-4}$ | $2.7\times10^{-5}$ | $5.4\times10^{-4}$ |
| A-4 | $3.0\times10^{-4}$ | $3.0\times10^{-5}$ | $6.0\times10^{-4}$ |
| A-5 | $3.3\times10^{-4}$ | $3.3\times10^{-5}$ | $6.6\times10^{-4}$ |

Each of resultant emulsions A-1 to A-5 was dissolved at 40° C. and immediately coated in the amount given in Table 2 below together with a protective layer on a cellulose triacetate film support having an undercoat layer.

Likewise, after being dissolved at 40° C., each of the emulsions A-1 to A-5 was aged under stirring for 12 hours and coated on a cellulose triacetate film support having an undercoat layer.

TABLE 2

| Emulsion coating conditions | |
|---|---|
| (1) Emulsion Layer | |
| Emulsion . . . Em A-1 to A-5 | (silver $2.1\times10^{-2}$ mol/m$^2$) |
| Coupler | ($1.5\times10^{-3}$ mol/m$^2$) |
| 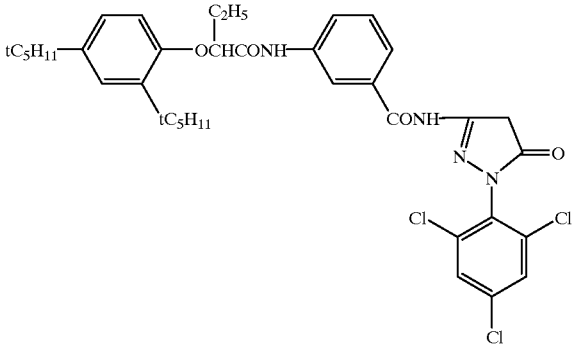 | |
| Tricresylphosphate | (1.10 g/m$^2$) |
| Gelatin | (2.30 g/m$^2$) |
| (2) Protective layer | |
| 2,4-dichloro-6-hydroxy-s-triazine sodium salt | (0.08 g/m$^2$) |
| Gelatin | (1.80 g/m$^2$) |

These samples were left to stand at a temperature of 40° C. and a relative humidity of 70% for 14 hours, exposed through a continuous wedge and a red filter for 1/100 second, and subjected to the following color development.

The density of each processed sample was measured by using a green filter.

| Process | Time | Temperature |
|---|---|---|
| Color development | 2 min. 00 sec. | 40° C. |
| Bleach-fixing | 3 min. 00 sec. | 40° C. |
| Washing (1) | 20 sec. | 35° C. |
| Washing (2) | 20 sec. | 35° C. |
| Stabilization | 20 sec. | 35° C. |
| Drying | 50 sec. | 65° C. |

The compositions of the individual processing solutions are given below.

| (Color developing solution) | (g) |
|---|---|
| Diethylenetriaminepentaacetate | 2.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |

-continued

| | |
|---|---|
| 4-[N-ethyl-N-β-hydroxylethylamino]-2-methylaniline sulfate | 4.5 |
| Water to make | 1.0 l |
| pH | 10.05 |
| (Bleach-fixing solution) | (g) |
| Ferric ammonium ethylenediamine-tetraacetate dihydrate | 90.0 |
| Disodium ethylenediaminetetraacetate | 5.0 |
| Sodium sulfite | 12.0 |
| Ammonium thiosulfate aqueous solution (70%) | 260.0 ml |
| Acetic acid (98%) | 5.0 ml |
| Bleaching accelerator (represented below) | 0.01 mol |

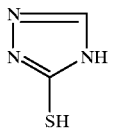

| | |
|---|---|
| Water to make | 1.0 l |
| pH | 6.0 |

Tap water was supplied to a mixed-bed column filled with an H type strongly acidic cation exchange resin (Amberlite IR-120B: available from Rohm & Haas Co.) and an OH type strongly basic anion exchange resin (Amberlite IR-400) to set the concentrations of calcium and magnesium to be 3 mg/l or less. Subsequently, 20 mg/l of sodium dichloroisocyanurate and 0.15 g/l of sodium sulfate were added.

The pH of the solution ranged from 6.5 to 7.5.

| (Stabilizing solution) | (g) |
|---|---|
| Formalin (37%) | 2.0 ml |
| Polyoxyethylene-p-monononylphenylether (average polymerization degree = 10) | 0.3 |
| Disodium ethylenediaminetetraacetate | 0.05 |
| Water to make | 1.0 l |
| pH | 5.0–8.0 |

The sensitivity is represented by a relative value of the logarithm of the reciprocal of an exposure amount (lux-sec) by which a density of fog +0.2 was given.

The results are summarized in Table 3 below.

As is apparent from Table 3, when the spectral sensitization was done by adding the cyanine dyes before the chemical sensitization, the maximum sensitivity was obtained by a certain predetermined amount of the sensitizing dyes. At the same time, a low fog was also obtained. This sensitizing dye amount corresponds to the emulsion A-4. If the sensitizing dye amount exceeded this amount, the sensitivity decreased. However, when the emulsion A-4 with the low fog and the highest sensitivity was aged in the form of a solution at 40° C., the fog increased, and the maximum color generation density decreased significantly. Therefore, an emulsion that can be used practically is A-2 or A-3.

It was found that the increase in fog and the decrease in maximum color generation density upon the solution aging of the emulsion A-4 were caused by aggregation of the emulsion grains.

Figure 2:
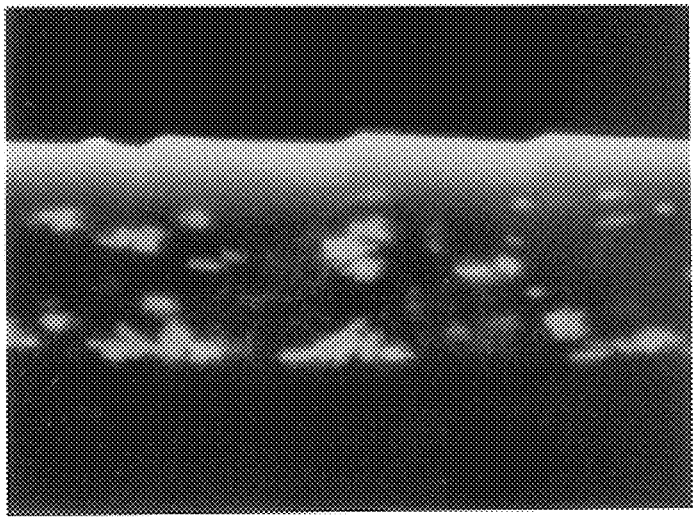
FIG. 2 is a sectional electron micrograph of the coated sample showing the grain structure of the emulsion A-4 prepared in the same example of the present invention and aged in the form of a solution for 12 hours.

FIGS. 1 and 2 are sectional electron micrographs of the coated samples showing the grain structures of the emulsion A-4 before and after the solution aging for 12 hours, respectively.

It is obvious from FIGS. 1 and 2 that individual grains were independently oriented in the coated film before the solution aging, whereas they agglomerated to form seemingly large grains after the solution aging. This agglomeration of the grains occurred between smooth surfaces of the tabular grains.

(Preparation of silver iodobromide fine-grain emulsion B)

A 1,000 ml portion of an aqueous solution containing 35 g of gelatin was held at 75° C., and an aqueous silver nitrate solution ($AgNO_3$ 43.8 g) and an aqueous KBr solution (containing 3.5 mol% of KI) were added by the double-jet method over five minutes. During the addition, the silver potential was kept at +70 mv with respect to a saturated calomel electrode. Thereafter, an aqueous silver nitrate solution ($AgNO_3$ 43.8 g) and an aqueous KBr solution (containing 10 mol% of KI) were added to the resultant solution by the double-jet method over 20 minutes. During the addition, the silver potential was kept at +70 mV with respect to the saturated calomel electrode. After the temperature was decreased, desalting was performed by the regular flocculation method, and gelatin was added to adjust the pH and the pAg to 6.3 and 8.6, respectively, at 40° C. The resultant emulsion was found to consist of tetradecahedral grains with an average equivalent-circle diameter of 0.12 $\mu$m (variation coefficient 9%). The surface silver iodide content corresponded to 10 mol% in respect of the formulation.

This silver iodobromide fine-grain emulsion B was added to the emulsion A-4, and the resultant emulsion was stirred at 60° C. for ten minutes.

Following the same procedures as described above, the emulsion was aged in the form of a solution and subjected to coating, exposure, and development, thereby obtaining the results summarized in Table 4 below.

TABLE 3

| | No solution aging | | | After solution aging for 12 hours | | |
|---|---|---|---|---|---|---|
| Emulsion name | Fog | Relative sensitivity | Maximum color generation density | Fog | Relative sensitivity | Maximum color generation density |
| A-1 | 0.21 | 100 | 2.7 | 0.21 | 100 | 2.7 |
| A-2 | 0.23 | 138 | 2.8 | 0.23 | 138 | 2.8 |
| A-3 | 0.23 | 170 | 2.8 | 0.25 | 155 | 2.4 |
| A-4 | 0.19 | 195 | 2.8 | 0.28 | 166 | 1.5 |
| A-5 | 0.12 | 78 | 2.7 | 0.17 | 105 | 1.4 |

TABLE 4

| Sample name | Addition amount of emulsion B with respect to emulsion A-4, as Ag amount (%) | No solution aging Fog | Relative sensitivity | Maximum color generation density | After solution aging for 12 hours Fog | Relative sensitivity | Maximum color generation density |
|---|---|---|---|---|---|---|---|
| 1 (Comparative example) | 0 | 0.19 | 195 | 2.8 | 0.28 | 166 | 1.5 |
| 2 (Present invention) | 0.5 | 0.19 | 195 | 2.8 | 0.23 | 186 | 2.3 |
| 3 (Present invention) | 1 | 0.19 | 209 | 2.8 | 0.20 | 209 | 2.7 |
| 4 (Present invention) | 3 | 0.19 | 229 | 2.8 | 0.19 | 229 | 2.8 |
| 5 (Present invention) | 6 | 0.19 | 229 | 2.8 | 0.19 | 229 | 2.8 |
| 6 (Present invention) | 12 | 0.20 | 219 | 2.8 | 0.20 | 219 | 2.8 |

As can be seen from Table 4, a sample 1 caused an increase in fog and a large decrease in maximum color generation density when aged in the form of a solution. In samples 2 to 6, however, in which the silver iodobromide fine-grain emulsion was added at the end of chemical sensitization, it was possible to reduce both the increase in fog and the decrease in maximum color generation density resulting from the solution aging. Especially in the samples 4 to 6 in which the silver iodobromide fine-grain emulsion was added in an amount of 3 mol% or more as an Ag amount, neither the increase in fog nor the decrease in maximum color generation density was found even after the solution aging. It was most surprising that the sensitivity was increased in the samples in which the silver iodobromide fine-grain emulsion of the present invention was added at the end of chemical sensitization.

Example 2

The surface silver iodide content dependence of a silver iodobromide fine-grain emulsion to be added during or after chemical sensitization will be described.

(Preparation of silver iodobromide fine-grain emulsions C-1 to C-6)

A 1,000 ml portion of an aqueous solution containing 35 g of gelatin was held at 65° C., and an aqueous silver nitrate solution ($AgNO_3$ 43.8 g) and an aqueous KBr solution were added by a double-jet method over five minutes. During the addition, the silver potential was kept at +70 mv with respect to a saturated calomel electrode. Thereafter, an aqueous silver nitrate solution ($AgNO_3$ 43.8 g) and aqueous KBr solutions (containing 0, 3, 5, 10, 15, and 20 mol% of KI) were added to the resultant solution by the double-jet method over 20 minutes. During the addition, the silver potential was kept at +70 mv with respect to the saturated calomel electrode. After the temperature was decreased, desalting was performed by a regular flocculation method, and gelatin was added to adjust the pH and the pAg to 6.3 and 8.6, respectively, at 40° C. Each resultant emulsion was found to consist of tetradecahedral grains with an average equivalent-circle diameter of 0.13 $\mu$m (variation coefficient 8% to 10%). The surface iodide contents of these emulsions, i.e., emulsions C-1, C-2, C-3, C-4, C-5, and C-6 corresponded to 0, 3, 5, 10, 15, and 20 mol%, respectively, in respect of the formulation.

These silver bromide and silver iodobromide fine-grain emulsions C-1 to C-6 were added in a silver amount of 4% to the emulsion A-4, and each resultant emulsion was stirred at 60° C. for ten minutes.

Following the same procedures as in Example 1, each emulsion was aged in the form of a solution and subjected to coating, exposure, and development, thereby obtaining the results summarized in Table 5 below.

TABLE 5

| Sample name | Added emulsion | No solution aging Fog | Relative sensitivity | Maximum color generation density | After solution aging for 12 hours Fog | Relative sensitivity | Maximum color generation density |
|---|---|---|---|---|---|---|---|
| 7 (Comparative example) | C-1 | 0.19 | 209 | 2.7 | 0.20 | 200 | 2.4 |
| 8 (Present invention) | C-2 | 0.19 | 229 | 2.8 | 0.19 | 229 | 2.7 |

TABLE 5-continued

| Sample name | Added emulsion | No solution aging | | | After solution aging for 12 hours | | |
|---|---|---|---|---|---|---|---|
| | | Fog | Relative sensitivity | Maximum color generation density | Fog | Relative sensitivity | Maximum color generation density |
| 9 (Present invention) | C-3 | 0.19 | 229 | 2.8 | 0.19 | 229 | 2.8 |
| 10 (Present invention) | C-4 | 0.19 | 229 | 2.8 | 0.19 | 229 | 2.8 |
| 11 (Present invention) | C-5 | 0.19 | 229 | 2.8 | 0.19 | 229 | 2.8 |
| 12 (Present invention) | C-6 | 0.18 | 214 | 2.7 | 0.18 | 204 | 2.6 |

As shown in Table 5, when the surface silver iodide content of the fine-grain emulsion added at the end of chemical sensitization was 0 mol% (a sample 7), both the relative sensitivity and the maximum color generation density were decreased by the solution aging. The relative sensitivity of this sample was low even when no solution aging was done. A similar tendency was found when the surface silver iodide content was 20 mol% (a sample 12). This indicates that an optimal amount exists in the surface silver iodide content of the silver iodobromide fine-grain emulsion.

Example 3

The grain size dependence of a silver iodobromide fine-grain emulsion to be added during or after chemical sensitization will be described.

(Preparation of silver iodobromide fine-grain emulsions D-1 to D-6)

Silver iodobromide fine-grain emulsions D-1 to D-6 were prepared by changing the temperature and the addition rate of an aqueous silver nitrate solution in the preparation of the silver iodobromide fine-grain emulsion B obtained in Example 1.

Consequently, the emulsion D-1 consisted of tetradecahedral grains with an average equivalent-circle diameter of 0.05 μm (variation coefficient 14%); the emulsion D-2 consisted of tetradecahedral grains with an average equivalent-circle diameter of 0.08 μm (variation coefficient 12%); the emulsion D-3 consisted of tetradecahedral grains with an average equivalent-circle diameter of 0.12 μm (variation coefficient 9%); the emulsion D-4 consisted of cubic grains with an average equivalent-circle diameter of 0.19 μm (variation coefficient 8%); the emulsion D-5 consisted of cubic grains with an average equivalent-circle diameter of 0.25 μm (variation coefficient 7%); and the emulsion D-6 consisted of cubic grains with an average equivalent-circle diameter of 0.30 μm (variation coefficient 7%).

These silver bromide and silver iodobromide fine-grain emulsions D-1 to D-6 were added in a silver amount of 3% to the emulsion A-4, and each resultant emulsion was stirred at 60° C. for ten minutes.

Following the same procedures as in Example 1, each emulsion was aged in the form of a solution and subjected to coating, exposure, and development, thereby obtaining the results summarized in Table 6 below.

TABLE 6

| Sample name | Added emulsion | No solution aging | | | After solution aging for 12 hours | | |
|---|---|---|---|---|---|---|---|
| | | Fog | Relative sensitivity | Maximum color generation density | Fog | Relative sensitivity | Maximum color generation density |
| 13 | D-1 | 0.19 | 199 | 2.7 | 0.19 | 199 | 2.5 |
| 14 | D-2 | 0.19 | 299 | 2.8 | 0.19 | 229 | 2.7 |
| 15 | D-3 | 0.19 | 229 | 2.8 | 0.19 | 229 | 2.8 |
| 16 | D-4 | 0.19 | 229 | 2.8 | 0.19 | 229 | 2.8 |
| 17 | D-5 | 0.19 | 209 | 2.8 | 0.19 | 209 | 2.7 |
| 18 | D-6 | 0.19 | 204 | 2.8 | 0.19 | 195 | 2.4 |

As can be seen from Table 6, when the grain size of the fine-grain emulsion added at the end of chemical sensitization was either 0.05 μm (a sample 13) or 0.30 μm (a sample 18), the maximum color generation density was decreased by the solution aging. In these samples, the relative sensitivity was low even when no solution aging was done. This demonstrates that an optimal amount exists in the grain size of the silver iodobromide fine-grain emulsion.

Example 4

Layers having the compositions presented below were coated on an undercoated cellulose triacetate film support to make a sample 101 as a multilayered color light-sensitive material.

(Compositions of light-sensitive layers)

The main materials used in the individual layers are classified as follows.

ExC: Cyan coupler

ExM: Magenta coupler

ExY: Yellow coupler

ExS: Sensitizing dye

UV : Ultraviolet absorbent

HBS: High-boiling organic solvent

H : Gelatin hardener

The number corresponding to each component indicates the coating amount in units of g/m$^2$. The coating amount of a silver halide is represented by the amount of silver. The coating amount of each sensitizing dye is represented in units of mols per mol of silver halide in the same layer.

(Sample 101)

1st layer (Antihalation layer)

| | | |
|---|---|---|
| Black colloidal silver | silver | 0.18 |
| Gelatin | | 1.40 |
| ExM-1 | | 0.18 |
| ExF-1 | | $2.0 \times 10^{-3}$ |
| HBS-1 | | 0.20 |

2nd layer (Interlayer)

| | | |
|---|---|---|
| Silver iodobromide emulsion G | silver | 0.065 |
| 2,5-di-t-pentadecylhydroquinone | | 0.18 |
| ExC-2 | | 0.020 |
| UV-1 | | 0.060 |
| UV-2 | | 0.080 |
| UV-3 | | 0.10 |
| HBS-1 | | 0.10 |
| HBS-2 | | 0.020 |
| Gelatin | | 1.04 |

3rd layer (Low-speed red-sensitive emulsion layer)

| | | |
|---|---|---|
| Silver iodobromide emulsion A | silver | 0.25 |
| Silver iodobromide emulsion C | silver | 0.25 |
| ExS-1 | | $6.9 \times 10^{-5}$ |
| ExS-2 | | $1.8 \times 10^{-5}$ |
| ExS-3 | | $3.1 \times 10^{-4}$ |
| ExC-1 | | 0.17 |
| ExC-3 | | 0.030 |
| ExC-4 | | 0.10 |
| ExC-5 | | 0.020 |
| ExC-7 | | 0.0050 |
| ExC-8 | | 0.010 |
| Cpd-2 | | 0.025 |
| HBS-1 | | 0.10 |
| Gelatin | | 0.87 |

4th layer (Medium-speed red-sensitive emulsion layer)

| | | |
|---|---|---|
| Silver iodobromide emulsion D | silver | 0.70 |
| ExS-1 | | $3.5 \times 10^{-4}$ |
| ExS-2 | | $1.6 \times 10^{-5}$ |
| ExS-3 | | $5.1 \times 10^{-4}$ |
| ExC-1 | | 0.13 |
| ExC-2 | | 0.060 |
| ExC-3 | | 0.0070 |
| ExC-4 | | 0.090 |

-continued

| | | |
|---|---|---|
| ExC-5 | | 0.025 |
| ExC-7 | | 0.0010 |
| ExC-8 | | 0.0070 |
| Cpd-2 | | 0.023 |
| HBS-1 | | 0.10 |
| Gelatin | | 0.75 |

5th layer (High-speed red-sensitive emulsion layer)

| | | |
|---|---|---|
| Silver iodobromide emulsion E | silver | 1.40 |
| ExS-1 | | $2.4 \times 10^{-4}$ |
| ExS-2 | | $1.0 \times 10^{-4}$ |
| ExS-3 | | $3.4 \times 10^{-4}$ |
| ExC-1 | | 0.12 |
| ExC-3 | | 0.045 |
| ExC-6 | | 0.020 |
| ExC-8 | | 0.025 |
| Cpd-2 | | 0.050 |
| HBS-1 | | 0.22 |
| HBS-2 | | 0.10 |
| Gelatin | | 1.20 |

6th layer (Interlayer)

| | | |
|---|---|---|
| Cpd-1 | | 0.10 |
| HBS-1 | | 0.50 |
| Gelatin | | 1.10 |

7th layer (Low-speed green-sensitive emulsion layer)

| | | |
|---|---|---|
| Silver iodobromide emulsion C | silver | 0.35 |
| ExS-4 | | $3.0 \times 10^{-5}$ |
| ExS-5 | | $2.1 \times 10^{-4}$ |
| ExS-6 | | $8.0 \times 10^{-4}$ |
| ExM-1 | | 0.010 |
| ExM-2 | | 0.33 |
| ExM-3 | | 0.086 |
| ExY-1 | | 0.015 |
| HBS-1 | | 0.30 |
| HBS-3 | | 0.010 |
| Gelatin | | 0.73 |

8th layer (Medium-speed green-sensitive emulsion layer)

| | | |
|---|---|---|
| Silver iodobromide emulsion D | silver | 0.80 |
| ExS-4 | | $3.2 \times 10^{-5}$ |
| ExS-5 | | $2.2 \times 10^{-4}$ |
| ExS-6 | | $8.4 \times 10^{-4}$ |
| ExM-2 | | 0.13 |
| ExM-3 | | 0.030 |
| ExY-1 | | 0.018 |
| HBS-1 | | 0.16 |
| HBS-3 | | $8.0 \times 10^{-3}$ |
| Gelatin | | 0.90 |

9th layer (High-speed green-sensitive emulsion layer)

| | | |
|---|---|---|
| Silver iodobromide emulsion E | silver | 1.25 |
| ExS-4 | | $3.7 \times 10^{-5}$ |
| ExS-5 | | $8.1 \times 10^{-5}$ |
| ExS-6 | | $3.2 \times 10^{-4}$ |

-continued

| | |
|---|---|
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |

10th layer (Yellow filter layer)

| | | |
|---|---|---|
| Yellow colloidal silver | silver | 0.030 |
| Cpd-1 | | 0.16 |
| HBS-1 | | 0.60 |
| Gelatin | | 0.60 |

11th layer (Low-speed blue-sensitive emulsion layer)

| | | |
|---|---|---|
| Silver iodobromide emulsion C | silver | 0.18 |
| ExS-7 | | $8.6 \times 10^{-4}$ |
| ExY-1 | | 0.020 |
| ExY-2 | | 0.22 |
| ExY-3 | | 0.50 |
| ExY-4 | | 0.020 |
| HBS-1 | | 0.28 |
| Gelatin | | 1.10 |

12th layer (Medium-speed blue-sensitive emulsion layer)

| | | |
|---|---|---|
| Silver iodobromide emulsion D | silver | 0.40 |
| ExS-7 | | $7.4 \times 10^{-4}$ |
| ExC-7 | | $7.0 \times 10^{-3}$ |
| ExY-2 | | 0.050 |
| ExY-3 | | 0.10 |
| HBS-1 | | 0.050 |
| Gelatin | | 0.78 |

13th layer (High-speed blue-sensitive emulsion layer)

| | | |
|---|---|---|
| Silver iodobromide emulsion F | silver | 1.00 |
| ExS-7 | | $4.0 \times 10^{-4}$ |
| ExY-2 | | 0.10 |
| ExY-3 | | 0.10 |
| HBS-1 | | 0.070 |
| Gelatin | | 0.86 |

14th layer (1st protective layer)

| | | |
|---|---|---|
| Silver iodobromide emulsion G | silver | 0.20 |
| UV-4 | | 0.11 |
| UV-5 | | 0.17 |
| HBS-1 | | $5.0 \times 10^{-2}$ |
| Gelatin | | 1.00 |

15th layer (2nd protective layer)

| | |
|---|---|
| H-1 | 0.40 |
| B-1 (diameter 1.7 μm) | $5.0 \times 10^{-2}$ |
| B-2 (diameter 1.7 μm) | 0.10 |
| B-3 | 0.10 |
| S-1 | 0.20 |
| Gelatin | 1.20 |

In addition to the above components, to improve storage stability, processability, a resistance to pressure, antiseptic and mildew proofing properties, antistatic properties, and coating properties, the individual layers contained W-1 to W-3, B-4 to B-6, F-1 to F-17, iron salt, lead salt, gold salt, platinum salt, iridium salt, and rhodium salt. The emulsions represented by the symbols are listed in Table 7 below.

TABLE 7

| | | Average AgI content (%) | Average grain size (μm) | Variation coefficient (%) of grain size | Diameter/ thickness ratio | Silver amount ratio [core/intermediate/shell] (AgI content) | Grain structure/shape |
|---|---|---|---|---|---|---|---|
| Emulsion | A | 4.0 | 0.45 | 27 | 1 | [1/3] (13/1) | Double-structure octahedral grain |
| | B | 8.9 | 0.70 | 14 | 1 | [3/7] (25/2) | Double-structure octahedral grain |
| | C | 2.0 | 0.55 | 25 | 7 | — | Uniform-structure tabular grain |
| | D | 9.0 | 0.65 | 25 | 6 | [12/59/29] (0/11/8) | Triple-structure tabular grain |
| | E | 9.0 | 0.85 | 23 | 5 | [8/59/33] (0/11/8) | Triple-structure tabular grain |
| | F | 14.5 | 1.25 | 25 | 3 | [37/63] (34/3) | Double-structure plate grain |
| | G | 1.0 | 0.07 | 15 | 1 | — | Uniform-structure fine grain |

In Table 7, (1) The emulsions A to F were subjected to reduction sensitization during grain preparation by using thiourea dioxide and thiosulfonic acid in accordance with the examples in JP-A-2-191938.

(2) The emulsions A to F were subjected to gold sensitization, sulfur sensitization, and selenium sensitization in the presence of the spectral sensitizing dyes described in the individual light-sensitive layers and sodium thiocyanate in accordance with the examples in JP-A-3-237450.

(3) The preparation of tabular grains was performed by using low-molecular weight gelatin in accordance with the examples in JP-A-1-158426.

(4) Dislocation lines as described in JP-A-3-237450 were observed in tabular grains and regular-crystal grains having a grain structure when a high-voltage electron microscope was used.

The above compounds represented by the symbols are presented below.

ExC-1

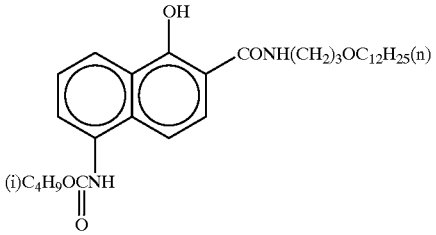

ExC-2

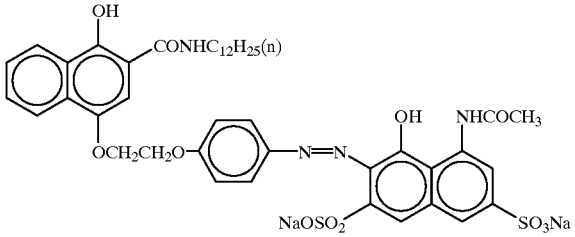

ExC-3

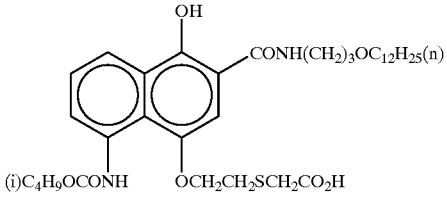

ExC-4

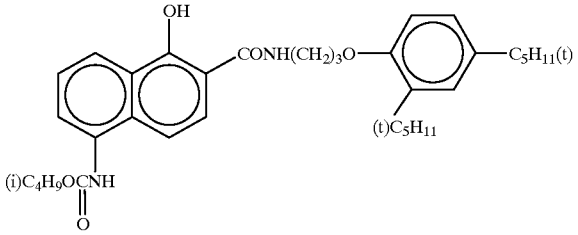

ExC-5

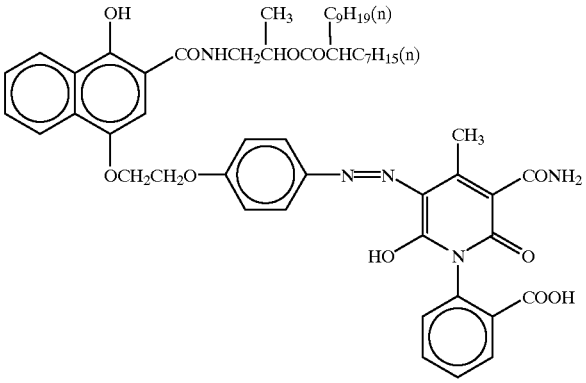

ExC-6

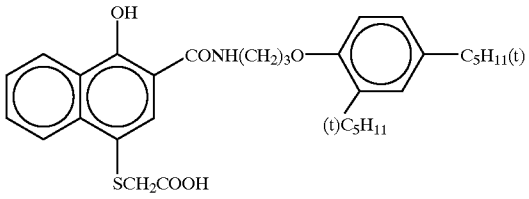

-continued
ExC-7
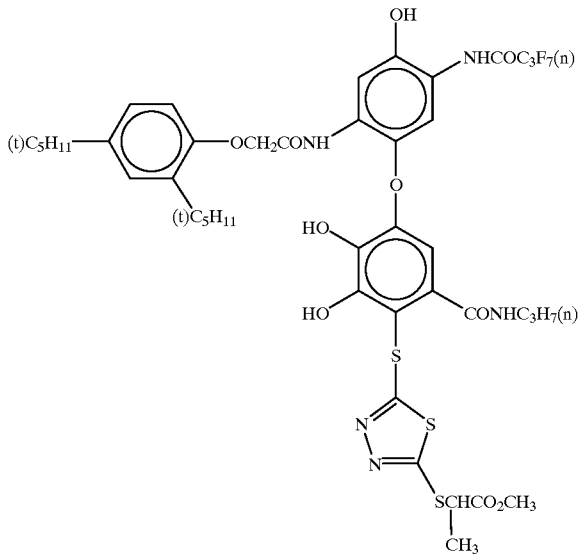
ExC-8
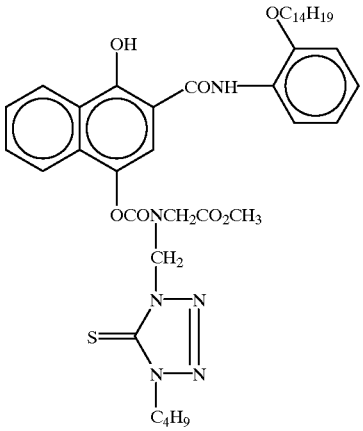
ExM-1
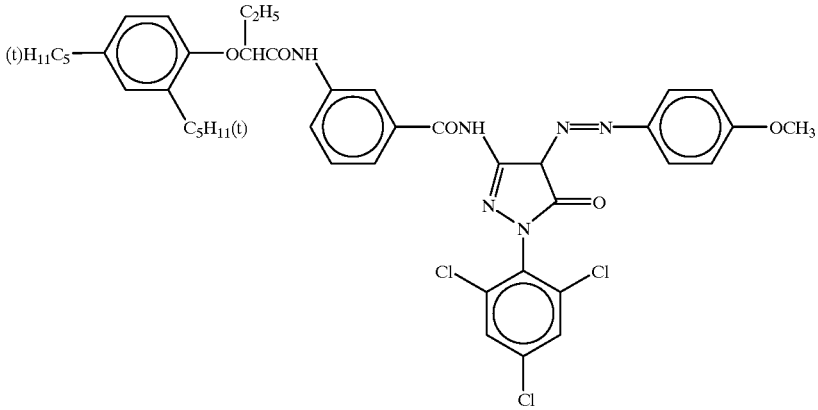
ExM-2
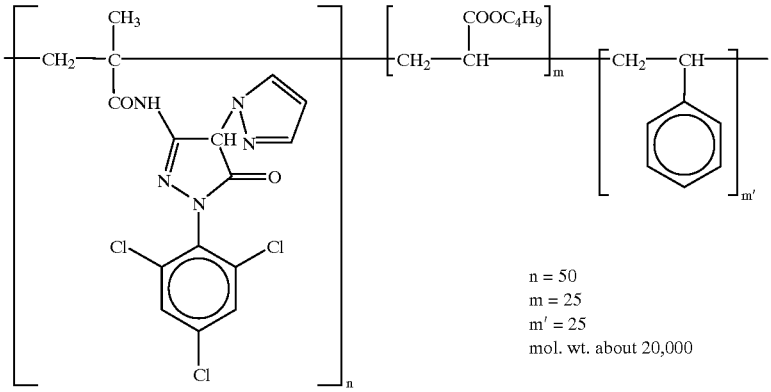
n = 50
m = 25
m′ = 25
mol. wt. about 20,000

-continued
ExM-3
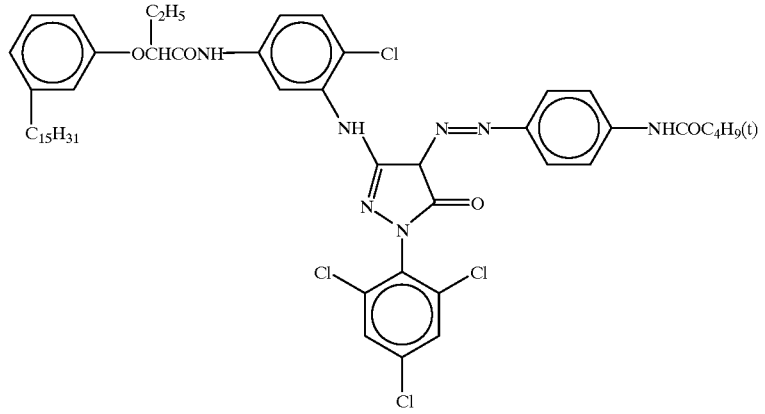
ExM-4
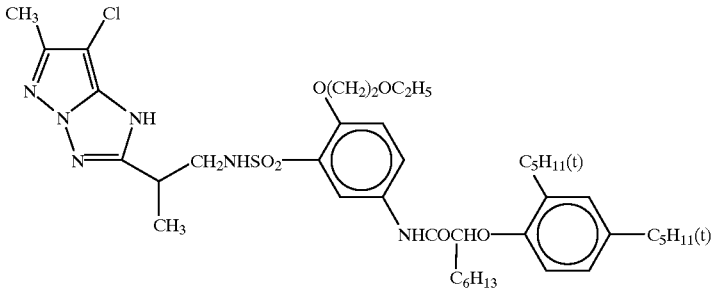
ExM-5
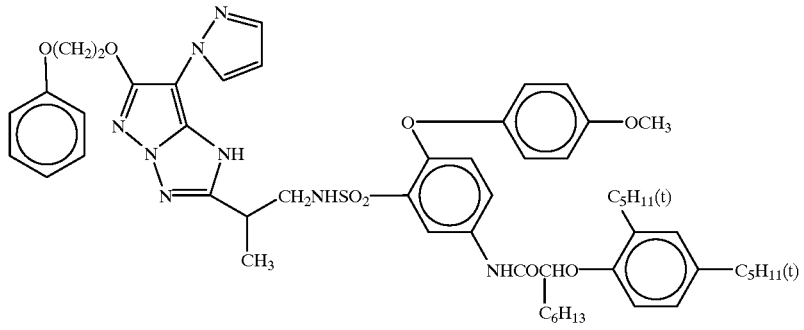
ExY-1
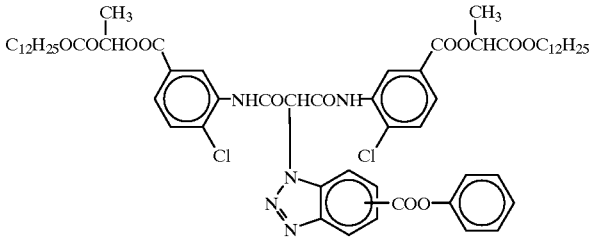
ExY-2
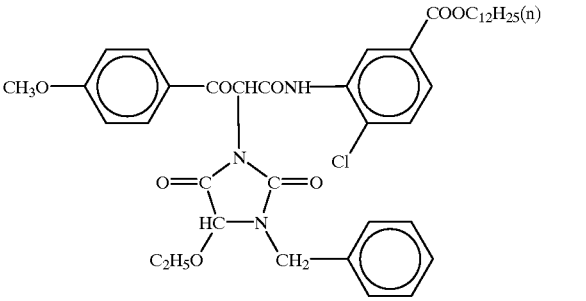

-continued
ExY-3
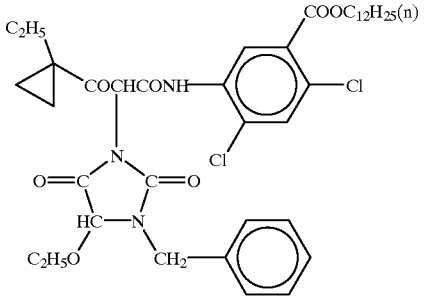
ExY-4
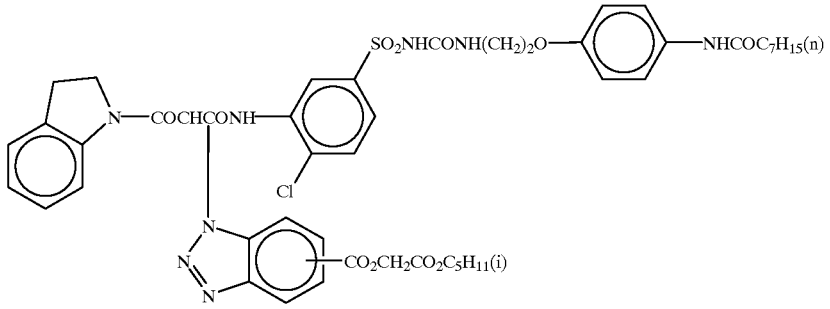
Cpd-1
ExF-1
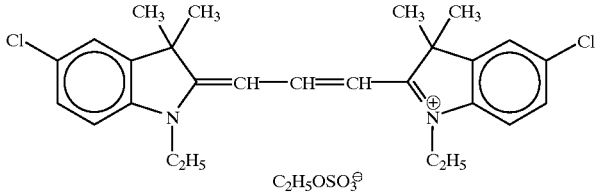
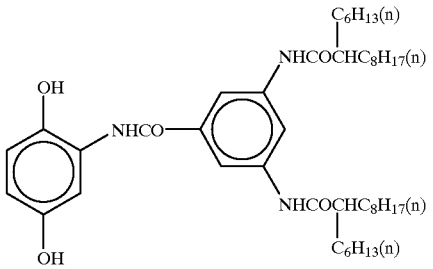
Cpd-2
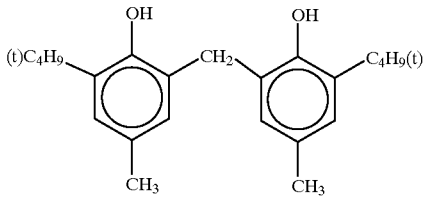
Cpd-3
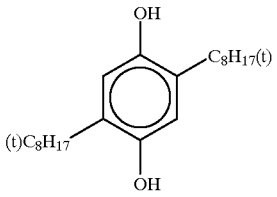
UV-1
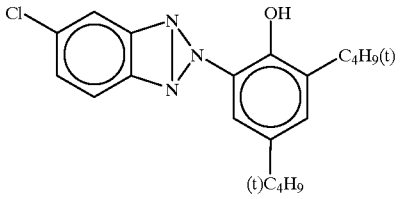
UV-2
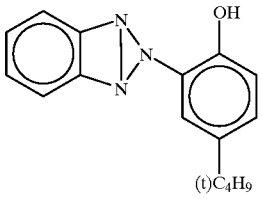

-continued
UV-3
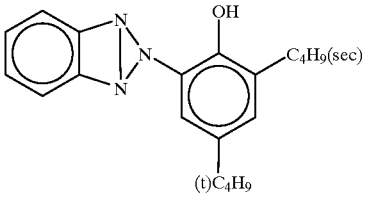
UV-4
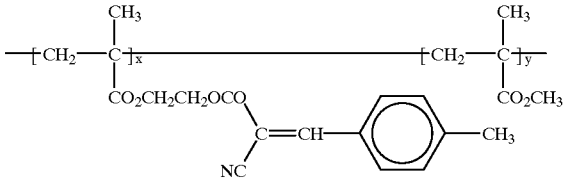
x:y = 70:30 (wt%)
UV-5
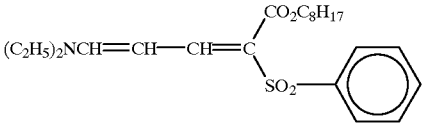
HBS-1
tricresylphosphate
HBS-2
di-n-butylphtalate
HBS-3
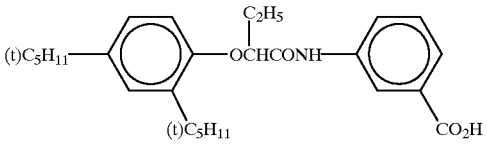
ExS-1
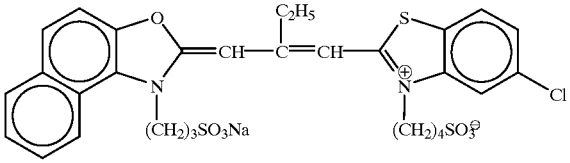
ExS-2
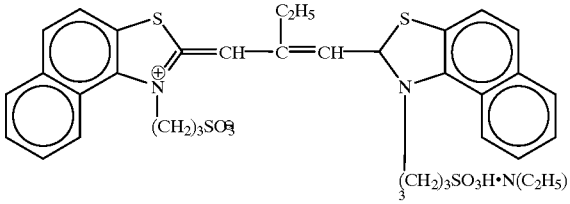
ExS-3
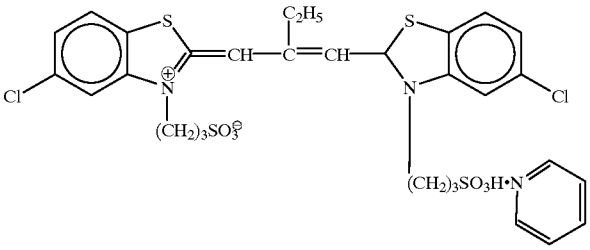
ExS-4
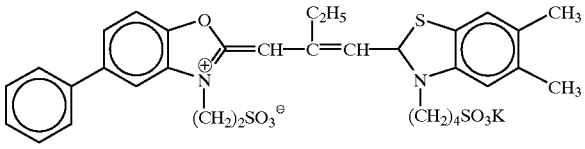
ExS-5
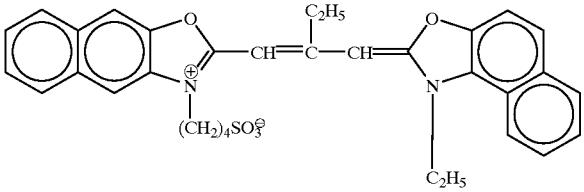
ExS-6
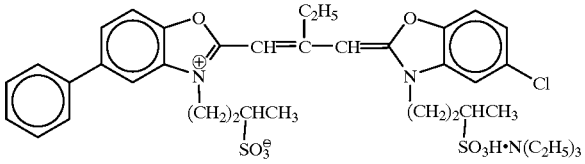
ExS-7
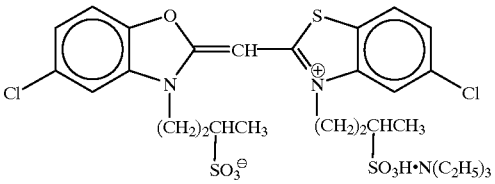
S-1
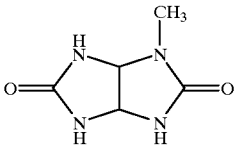
H-1
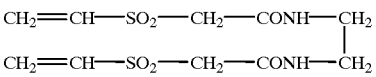
B-1
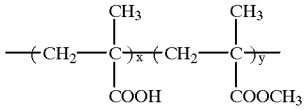
x/y = 10/90

-continued
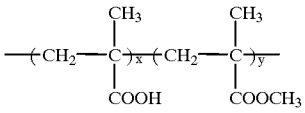
x/y = 40/60
B-2
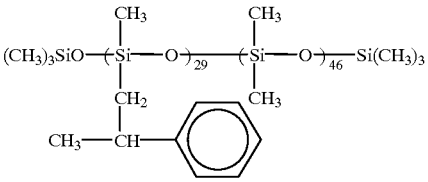
B-3
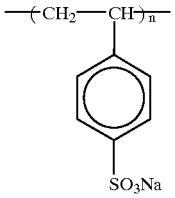
B-4
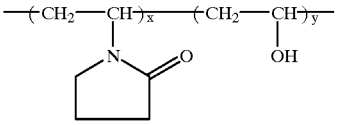
x/y = 70/30
B-5
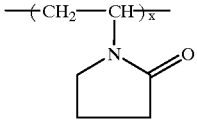
(mol. wt. about 10,000)
B-6
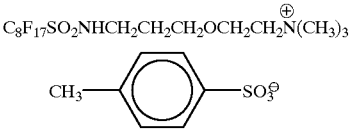
W-1
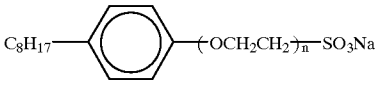
n = 2 - 4
W-2
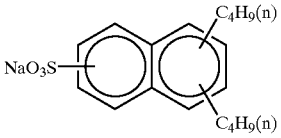
W-3
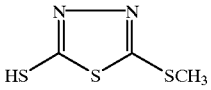
F-1
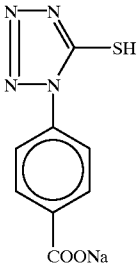
F-2
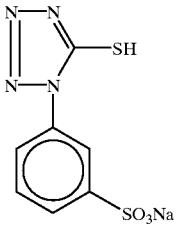
F-3
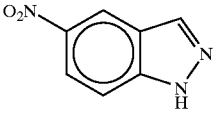
F-4
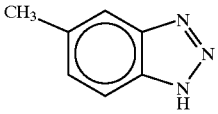
F-5
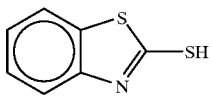
F-6
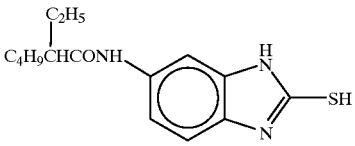
F-7
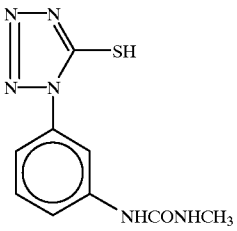
F-8

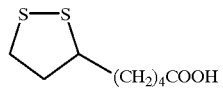

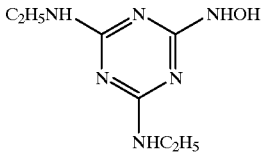

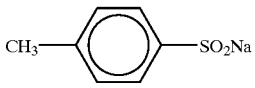

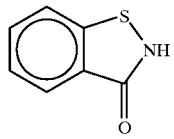

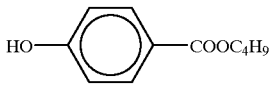

-continued

F-9

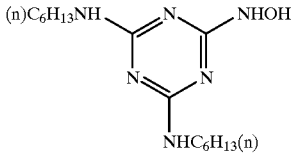

F-10

F-11

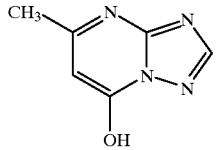

F-12

F-13

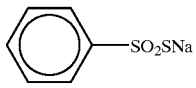

F-14

F-15

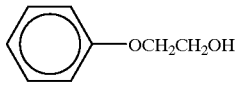

F-16

F-17

The sample 101 thus formed was exposed and then developed in accordance with the standard processing CN-16X for Fuji Color negative films (this processing is exactly the same as described in Example 1 of JP-A-5-19430 except the composition of the stabilizer is slightly different).

Excellent results similar to the effects described in Examples 1 to 3 above were obtained by the sample 101 made by using the emulsion corresponding to the sample 4 described in Example 1 in the 5th layer (high-speed red-sensitive emulsion layer) of the multilayered color light-sensitive material described above.

According to the present invention, it is possible to eliminate the agglomeration of silver halide grains which is of a problem in performing spectral sensitization by adding a large amount of cyanine dyes during or before chemical sensitization. At the same time, a high sensitivity can be achieved without increasing fog by adding the silver iodobromide fine-grain emulsions of the present invention.

What is claimed is:

1. A method of preparing a tabular silver halide negative emulsion having silver halide grains in which not less than 50% of a total projected area is accounted for by tabular silver halide grains with an aspect ratio of not less than 5, comprising:

forming a first tabular silver halide negative emulsion comprising tabular silver halide grains;

performing spectral sensitization of the first tabular silver halide negative emulsion by adding a trimethinecyanine dye in an amount of not less than 60% of a saturation coverage of said tabular silver halide grains during or before chemical sensitization; and adding, during or after the chemical sensitizations to said first tabular silver halide negative emulsions, a second silver iodobromide fine-grain emulsion having a sensitivity not higher than 1/10 the sensitivity of said first tabular silver halide negative emulsion, wherein 20% or less of said second silver iodobromide fine-grain emulsion is soluble and wherein said fine grains have an average equivalent-circle diameter of 0.05 to 0.30 $\mu$m and a surface silver iodide content of 3 to 20 mol% to eliminate agglomeration of said tabular silver halide grains of said tabular silver halide negative emulsion.

2. The method according to claim 1, wherein said second silver iodobromide fine-grain emulsion comprises regular crystal grains.

3. The method according to claim 1, wherein the addition amount of said trimethinecyanine dye is 70% to 100% with respect to the saturation coverage.

4. The method according to claim 1, wherein said second silver iodobromide fine-grain emulsion consists of monodisperse grains with a variation coefficient of 20% or less.

5. The method according to claim 1, wherein said second silver iodobromide fine-grain emulsion is added in an amount of 1 to 10 mol%, as a silver amount, with respect to said first tabular silver halide negative emulsion which is spectrally sensitized.

6. The method according to claim 1, wherein said second silver iodobromide fine-grain emulsion is added in an amount of 2 to 8 mol%, as a silver amount, with respect to said first tabular silver halide negative emulsion which is spectrally sensitized.

7. The method according to claim 1, wherein antifoggants or stabilizers are added after the end of chemical sensitization, and said second silver iodobromide fine-grain emulsion is added after the addition of said antifoggants or stabilizers.

* * * * *